US005120400A

United States Patent [19]

Laapotti

[11] Patent Number: 5,120,400

[45] Date of Patent: Jun. 9, 1992

[54] HEATING METHOD AND DEVICE IN A PAPER MACHINE PRESS SECTION PROVIDED WITH A SEPARATE PRESS

[75] Inventor: Jorma Laapotti, Palokka, Finland

[73] Assignee: Valmet Paper Machinery Inc., Finland

[21] Appl. No.: 707,451

[22] Filed: May 30, 1991

[30] Foreign Application Priority Data

Jun. 6, 1990 [FI] Finland ..... 902820

[51] Int. Cl.[5] ..... D21F 3/04

[52] U.S. Cl. ..... 162/206; 162/359; 162/360.1

[58] Field of Search ..... 162/206, 207, 290, 305, 162/360.1, 359, 276

[56] References Cited

U.S. PATENT DOCUMENTS

| | | | |
|---|---|---|---|
| 3,560,333 | 2/1971 | Douglas et al. | 162/206 |
| 4,163,688 | 8/1979 | Kankaanpaa | 162/206 |
| 4,351,700 | 9/1982 | Dove | 162/290 |
| 4,662,398 | 5/1987 | Wywailowski et al. | 162/207 |
| 4,874,470 | 10/1989 | Skaugen | 162/359 |
| 4,919,762 | 4/1990 | Laapotti et al. | 162/359 |
| 4,976,820 | 11/1990 | Laapotti et al. | 162/358 |

*Primary Examiner*—Karen M. Hastings
*Attorney, Agent, or Firm*—Steinberg & Raskin

[57] ABSTRACT

Method and device for intensifying the dewatering of a web in a paper machine press section having a compact roll combination and a separate press. The web is pressed in press nips formed by a compact roll combination. Thereafter, the web is transferred on a paper guide roll onto the outer face of the press felt of the separate press, on which felt the web is transferred into the nip of the separate press. The web runs over the lower sector of the paper guide roll and before the web is transferred into the nip of the separate press, the web as well as the press felt of the separate press are heated by means of heating devices. By means of these devices, the temperature levels both of the web and of the outer face of the press felt of the separate nip which felt reaches contact with the web are raised so that the dewatering is substantially intensified in the separate nip.

19 Claims, 3 Drawing Sheets

HEATING METHOD AND DEVICE IN A PAPER MACHINE PRESS SECTION PROVIDED WITH A SEPARATE PRESS

FIELD OF THE INVENTION

The present invention is related to a method and apparatus in a paper machine press section provided with a separate press The web is pressed in press nips formed by a compact roll combination, after which the web is transferred on a paper guide roll onto the outer face of the press felt of the separate press, on which felt the web is transferred into the nip of the separate press.

BACKGROUND OF THE INVENTION

In the prior art, different compact and closed press sections are known, which are provided with a combination of press rolls, wherein the press rolls form, as a rule, at least three press nips with one another. Examples of these prior art press sections include applicant's "Sym-Press II" press section as well as the "Sym-Press O" press section (trademarks of Valmet Paper Machinery, Inc.).

In a "Sym-Press II" press section, the first twin-felt nip is formed between a hollow-faced lower press roll and an upper press-section roll. A suction roll forms a second nip with a smooth-faced center roll of the press, and a third press nip is also formed in connection with the center roll.

In a "Sym-Press O" press section, the first twin-felt horizontal nip is formed between a lower hollow-faced roll and an upper press-suction roll, after which the web follows the upper fabric as a vertical run into a second nip. The second nip is formed between a hollow-faced roll separate from the rolls of the first nip and the smooth-faced center roll. A third press nip in connection with said center roll is provided with a felt, is formed by means of a hollow-faced press roll.

In measurements carried out by the applicant, it has been noticed that, e.g. in the "Sym-Press II" press section described above, which is provided with a separate press (fourth press nip), the temperature of the web before the third press nip is about 3°-10° C. higher than before the fourth separate nip. If a steam box is employed (in a manner known in prior art) in connection with the center roll in the "Sym-Press II" press roll, by means of which steam box the temperature level of the smooth faced center roll is raised between the second and third nip, cooling takes place before the fourth nip even to a greater extent that what was stated above. Corresponding cooling of the web also takes place in a "Sym-Press O" press section provided with a separate nip, and in other, corresponding press section concepts.

However, cooling the web before the fourth nip lowers the efficiency of dewatering in the nip. Thus, for the purposes of energy economy, it is well known that dewatering by means of pressing is considerably more advantageous than dewatering by evaporation. Accordingly, all realistic measures should be taken to achieve a maximal dry solids content in the web in the dewatering taking place by pressing in order to achieve an efficient dewatering system.

The reasons for cooling the web in the press nips and during its transfer from the center roll of a press to a separate press include the following. The web is cooled as a result of its movement in air currents. The web is carried into the separate press over a considerably long distance on the top face of a relatively cool press felt.

Before the fourth nip, the web reaches direct contact with the colder smooth faced upper roll of the press on a certain advance covering sector.

With respect to the prior art, reference is made to U.S. Pat. No. 3,655,507, as well as to U.S. Pat. No. 3,560,333. From these publications, it is known in prior art to heat the press felt and the web before the web enters into the dewatering press nip. The heating arrangements known from said publications are, however, not satisfactorily suitable for use when attempts are made to raise the temperature level of the web to be pressed efficiently after the compact press roll combination before the web is passed into the separate nip.

Even though, in the following, the invention will be described with reference to the applicant's "Sym-Press II+separate nip" press section, it should be emphasized that the present invention is also suitable for use in other, corresponding press sections, such as the applicant's above-mentioned "Sym-Press O" press section and corresponding press constructions of other manufacturers of paper machines.

OBJECTS AND SUMMARY OF THE INVENTION

An object of the present invention is to avoid the drawbacks that have occurred in the prior art methods and devices and to provide novel solutions for the problems dealt with above.

Another object of the invention is to provide a novel, more efficient method and device by whose means it is possible to raise the pressing temperature of the paper web before a separate nip to a substantial nip to a substantial extent so that the efficiency of dewatering in the last, separate nip of the paper machine can be increased further substantially.

In view of achieving the above-mentioned objects and others, the present invention is related to a method in which when the web runs over the lower sector of a paper guide roll, before the web is transferred into the nip of the separate press, the web as well as the press felt of the separate press are heated by means of heating devices. By means of this heating, the temperature levels both of the web and of the outer face of the press felt (which contacts the web) of the separate nip are raised so that the dewatering is substantially intensified in the separate nip.

The present invention is also related to a press section of a paper machine for carrying out the method of the invention. The press section comprises a compact press roll arrangement which forms (along with other rolls) at least two, preferably three, press nips, the web being detached from the smooth-faced center roll of said press section by means of a paper guide roll and transferred onto the press felt of a separate press included in the press section and the web being transferred on the top face of said press felt into the nip of the separate press in the press section, which nip is formed between a smooth-faced upper roll and a hollow-faced press roll. The web is then transferred onto the lower felt of the separate nip by means of a transfer-suction roll as a short open draw or by means of a transfer nip.

In connection with the gap between the paper guide roll and the transfer-suction roll, underneath said paper guide roll, a heating arrangement is fitted. The heating arrangement extends across the entire transverse width of the web. By means of the heating arrangement, the temperature both of the web and of the press felt in the separate nip is raised so that the dewatering in the separate nip is intensified.

In the invention, the paper web is heated from underneath by means of a steam box or equivalent against a paper guide roll, whose diameter is preferably somewhat larger than those employed in prior art. During the threading of the web, the paper guide roll can be raised, as is the case in the prior art press sections. The paper guide roll may be smooth faced, or it may be provided with a perforated mantle and, if necessary, it may also be subjected to slight negative pressure.

When the web is steamed expressly from the lower side, flow of condensate onto the web is avoided, which would occur if the steam box were placed above the web before the separate press.

In a preferred embodiment of the invention, by means of a steam box or equivalent, the upper face of the felt of the separate press is also heated, which felt face is placed in direct contact with the paper web.

An alternative mode of heating is infrared heating taking place at a corresponding point, one advantage of this alternative mode of heating being that no additional water is introduced into the felt and web faces.

In one embodiment of the invention, lubricating water jets, employed in prior art for the doctors of the smooth upper roll, are substituted for by a steam jet that heats the roll, in which case the cleaning quality of the roll is also improved. The smooth upper roll of the separate press may be favorably provided with internal steam heating, and so may also the center roll if necessary.

After the separate press nip, an infrared heater may be placed against the smooth upper roll on the distance over which the web follows the upper roll. This arrangement raises the temperature of the web on its way to the drying section as well as raises the temperature of the roll and lowers the force of detaching of the web from the smooth upper roll.

BRIEF DESCRIPTION OF THE DRAWINGS

In the following, the invention will be described in detail with reference to some exemplifying embodiments of the invention illustrated in the figures in the accompanying drawings, the invention being in no way strictly confined to the details of said embodiments.

DETAILED DESCRIPTION OF THE INVENTION

Figure 1:
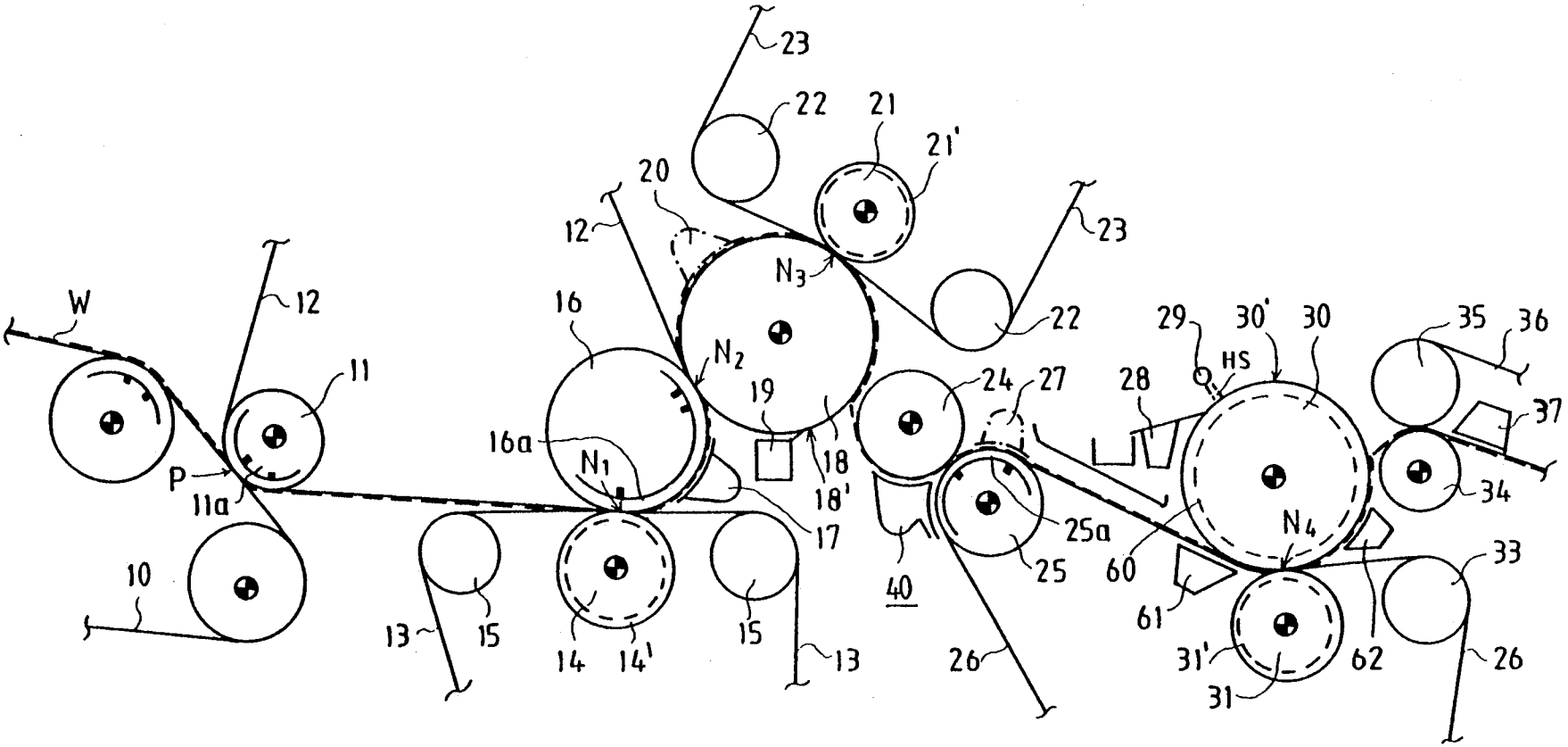
FIG. 1 is a schematic side view of the press geometry of the applicant's "Sym Press II+fourth press" provided with a method and device arrangement in accordance with the present invention.

FIG. 1 is a schematic illustration of the press section of a paper machine, in which the paper web W, which arrives from the forming wire 10 of the former, is dewatered by pressing. The web W is transferred from the wire 10 at the pick-up point P onto the press felt 12 on the suction zone 11*a* of the pick-up roll 11. On the pick-up felt 12, the web W is transferred into the first dewatering nip $N_1$, which is formed between the press-suction roll 16 and the hollow-faced 14' lower press roll 14. The first nip $N_1$ is a twin-felt nip, and it includes a lower felt 13 guided by guide rolls 15.

In FIG. 1, owing to the suction zone 16*a* of the suction roll 16, after the nip $N_1$, the web W follows the felt 12 into the second nip $N_2$, which is formed between said suction roll 16 and the smooth-faced 18' center roll 18 of the press. Between the nips $N_1$ and $N_2$ there is a steam box 17 that heats the web W directly. The third nip $N_3$ in the press is formed between said center roll 18 and the hollow-faced 21' press roll 21. The press felt 23, guided by the guide rolls 22, runs through the third nip $N_3$. On the lower sector of the center roll 18, there is a doctor 19, which keeps the smooth face 18' of the center roll 18 clean and detaches the web that becomes broke from the face 18'.

After the third nip $N_3$, the web W follows the smooth face 18' of the center roll 18, from which it is detached by means of a paper guide roll 24, which is provided with a drive gear. From the guide roll 24, the web W is transferred on the suction zone 25*a* of the transfer-suction roll 25 onto the press felt 26, which carries the web W on its upper face into the fourth, separate nip $N_4$ in the press section.

In FIG. 1, the press rolls 14, 16, 18 and 21 form a compact combination of rolls, which includes three subsequent nips $N_1$, $N_2$, $N_3$ through which the web W runs as a closed draw, being all the time supported by a felt or roll face. The fourth, separate nip $N_4$ is formed between a smooth-faced 30', large-diameter press roll 30 and a lower hollow-faced 31' press roll 31. After the fourth nip $N_4$, the web W follows the smooth face 30' from which it is separated by means of a paper guide roll 34, being transferred onto the drying wire 36 of the drying section, which wire 36 is guided by the guide roll 35. The web W is attached to the drying wire 36 by means of a suction box 37 and carried on the wire 36 to a multi-cylinder dryer (not shown). On the upper sector of the web press roll 30 in the separate nip $N_4$, there are spraying devices 29 and, after them a doctor 28, which keeps the roll face 30' clean.

The press construction described above is substantially known in prior art, and it has been described above just as a background as an environment of application for the present invention.

In view of intensification of the dewatering in the second nip $N_2$, there is a first steam supply box 17 on the suction sector 16*a* between the first and the second nip. In a corresponding way, between the second and the third nip $N_2$ and $N_3$, there is a second steam supply box 20 operating against the web W. By means of the hot steam fed out of the boxes 17 and 20, the elastic properties of the fibers in the web and the viscosity and the surface tension of the water contained in said web are affected so that the dewatering in the nips $N_2$ and $N_3$ is intensified.

Figure 2:
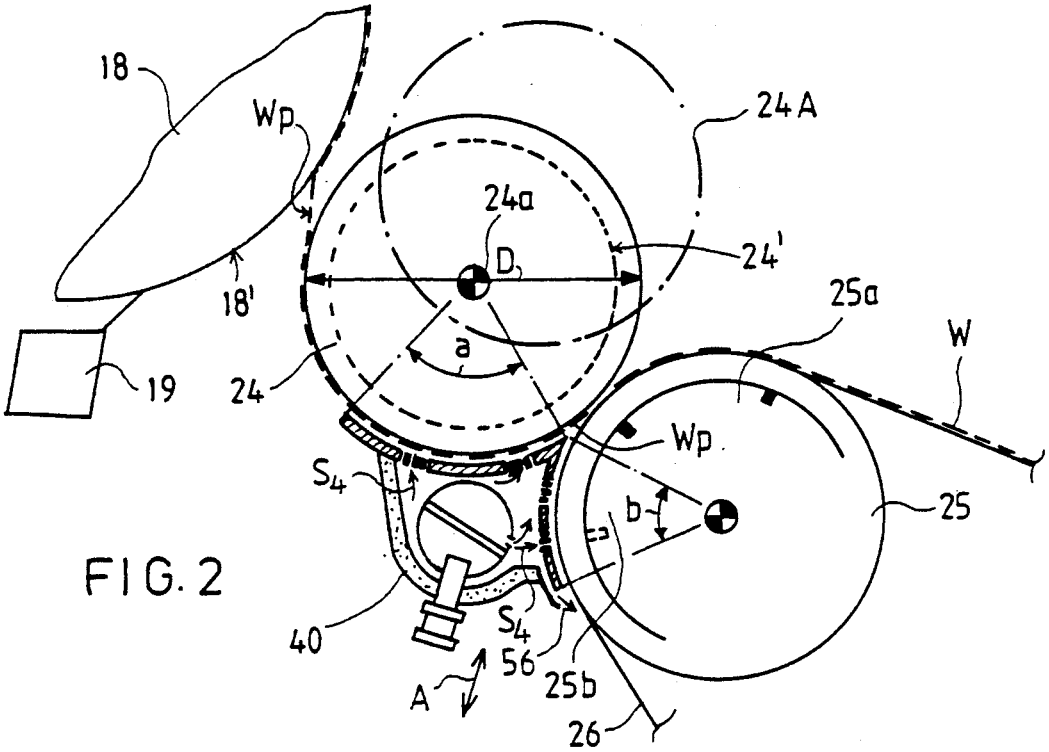
FIG. 2 is a vertical sectional view in the machine direction of a first embodiment of the device in accordance with the invention.

In the following, to start with, referring to FIG. 2, a first exemplifying embodiment of the invention will be described. As is shown in FIG. 2, the web W arrives onto the paper guide roll 24 as a short free draw $W_p$ from the smooth face 18' of the center roll 18. On the paper guide roll 24 the web W is heated from below by means of a steam box 40 placed in accordance with the present invention. The paper guide roll 24 is a roll provided with a drive gear 24*a* and having a diameter $D_1$ slightly larger than the diameter of a normal paper guide roll (e.g. from about 600 to about 800 mm) placed in this position. The diameter $D_1$ is, preferably, in a range of from about 800 to about 1200 mm. The roll 24 can be transferred to its upper position 24A in connection with the threading of the web W. The paper guide roll 24 may be provided either with a smooth face, with grooves, or with a perforated mantle 24', in which latter case a suction box is fitted inside the roll 24, in which suction box a slight negative pressure is employed. An alternative suction roll that has no suction box but sucks through the perforations of the entire roll is possible. On the section a of the roll 24, the web W is heated and steamed expressly from below, whereby flow of condensate onto the web W is avoided, which would take place if the steam box were placed above the web W.

The steam box 40 shown in FIG. 2 may, if necessary, be mounted by its ends on devices by whose means the steam box can be shifted out of its place of operation, for example, for the time of threading, and by means of which devices, if necessary, the magnitude of the steaming gap V can be fine-adjusted. The operation of these devices is illustrated in FIG. 2 by the narrow A.

As is shown in FIG. 2, the web W is transferred from the paper guide roll 24 as a short free draw $W_p$ onto the suction zone 25*a* of the transfer-suction roll 25 and onto the press felt 26 running over said roll and from the felt further into the fourth, separate nip $N_4$. Before the free draw $W_p$ of the web and before the suction zone 25*a*, the outer face of the felt 26 that becomes placed in contact with the paper web W is also heated by means of the steam box 40.

Figure 4:
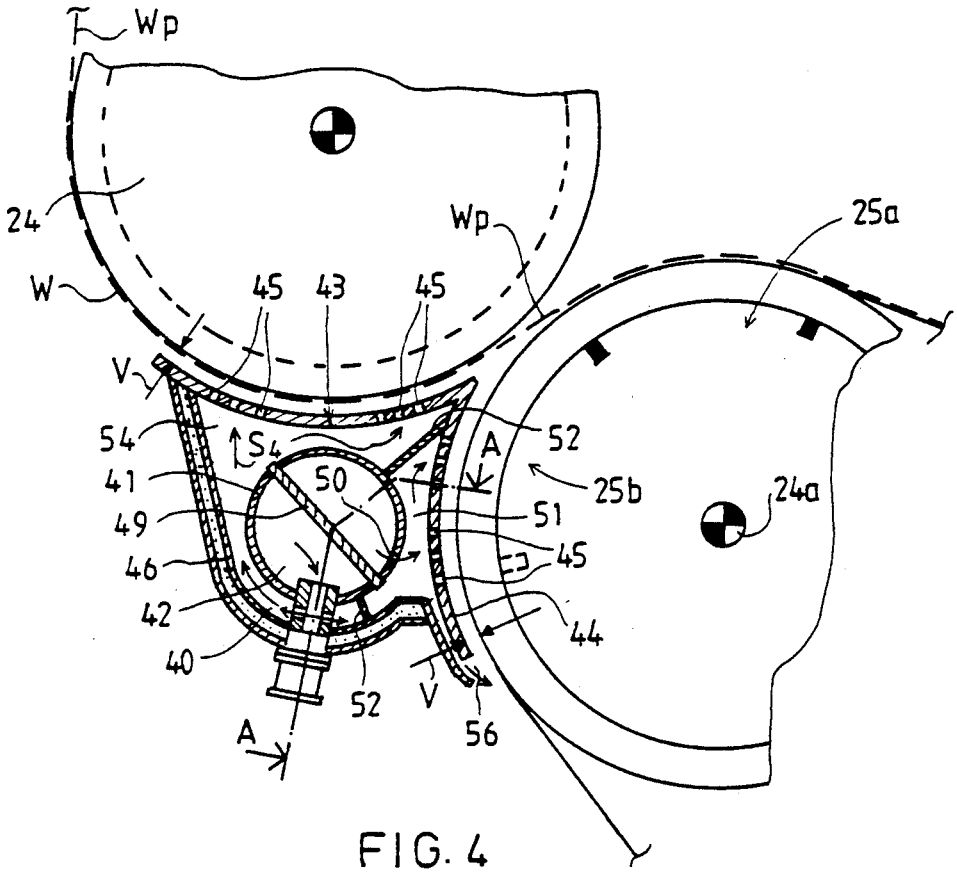
FIG. 4 is an enlarged vertical sectional view of a device as shown in FIG. 2.

As is shown in FIG. 4, for the steam treatment of the web W, the steam box 40 is provided with curved walls 44 and 45, which are placed at a distance of a little invariable gap V from the outer face of the web W running over the roll 24 and from the felt 26, which runs over the suction zone 25*b* of the roll 25, which suction zone 25*b* is preferable but not entirely indispensable. The walls 43 and 44 are provided with a series of nozzle holes 45, through which steam jets $S_4$ are directed at the web W and at the felt 26 in the steaming gaps V. Entrance of air, which moves on the face of the felt, into the steaming gap V, where the air hampers condensation of the steam into the felt face, can be prevented by means of a steam jet 56 directed upstream. An upstream steam jet may also be placed ahead of the steaming of the web (not shown), but such a jet is not particularly essential, because a thick air layer moving along with the web face has not yet had time to be formed at the web face, because of the detaching of the web from the roll taking place at the proximity.

Figure 5:
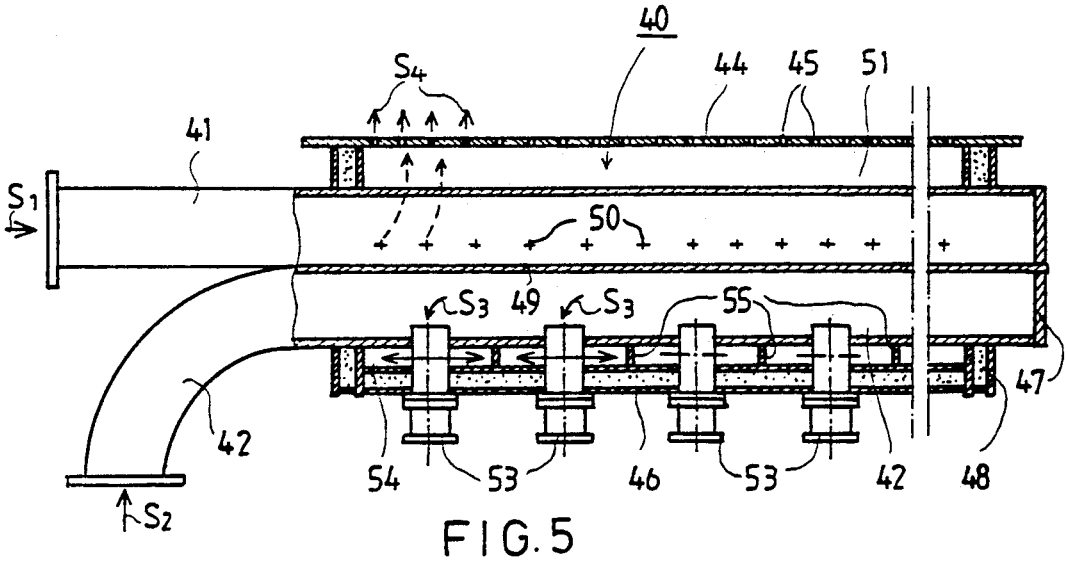
FIG. 5 is a sectional view taken along line A—A in FIG. 4.

The construction of the steam box 40 comes out best from FIGS. 4 and 5. Into the steam box 40, two steam supply pipes 41 and 42 pass, into which appropriate water steam is introduced in the direction s of the arrows $S_1$ and $S_2$. One end of the pipes 41 and 42 is provided with a closed wall 47. The steam box 40 is provided with a curved wall 46, which connects the walls 43 and 44 and is provided with heat insulation, as well as with an end wall 48, which is also provided with heat insulation. The steam pips 41 and 42 are combined in the steam box to make one pipe, which is provided with a partition wall 49. From the pipe compartment 41, steam supply openings 50 are opened into the space 51, which is defined by partition walls 52 and by a counter-face 44 provided with nozzle openings 45. The other pipe compartment 42, which is separated by the partition wall 49 from the pipe compartment 41, is opened into regulation valves 53. From the pipe compartment 42 the steam has access, in the direction of the arrow $S_3$, through the nozzle openings of the regulation valves 53 into the block spaces 54 provided with partition walls 55, out of which block spaces 54 the steam is discharged, in the direction of the arrows $S_4$, through the nozzle openings 45 provided in the wall 43 against the web W running over the roll 24. By means of the regulation valves 53 and the spaces 54, a regulation of the profile block by block is achieved, so that the transverse temperature profile of the web W can be controlled by means of the series of regulation valves 53 so that a web W with a temperature as uniform as possible in the transverse direction or with a maximally good profile of dry solids content is obtained.

In FIG. 1, a steam box 27 is also shown as fitted above the suction sector 25*a* of the transfer-suction roll 25, by means of which box 27 the upper face of the web W, i.e. the face opposite to the face heated by the steam box 40, is heated. The steam box 27 is not always necessary, and not even advantageous in all cases, because of the risk of dropping of water.

Figure 3:
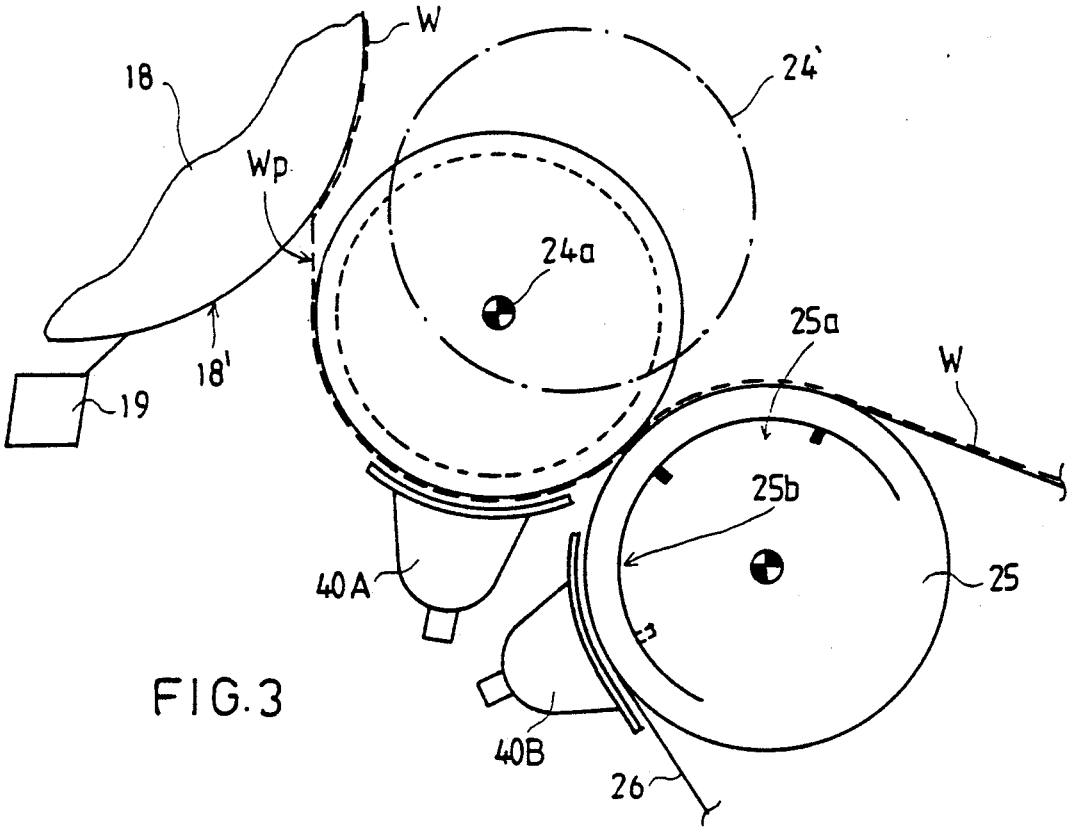
FIG. 3 shows a second embodiment of the invention in a way similar to FIG. 2.

As is shown in FIG. 3, the dual action steam box 40 shown in FIGS. 2, 4 and 5 has been substituted for by two separate steam boxes 40A and 40B, one 40A of which applies the steam treatment to the web W that runs over the roll 24, and the other one 40B to the outer face of the press felt 26 that runs over the roll 25. Both of the steam boxes 40A and 40B, or one of them, can be substituted for by some other heating device, such as infrared radiation heater, in which case no additional water is introduced into the face of the felt 26 and/or of the web W.

If necessary, the smooth-faced 30' upper roll 40 in the separate nip $N_4$ can be provided with internal steam heating 60 (FIG. 1). The prior art lubrication water jets for the doctor 29 of the smooth roll 30 have been substituted for by devices 29 which feed steam jets HS which heat the roll, in which case the quality of cleaning of the roll 30 face 30' is also improved. Before the separate nip $N_4$, inside the loop of the press felt 26, it is possible to provide a suction box 61 operating by means of the blow principal, by employing hot air, and after the fourth nip $N_4$, against the upper roll 30, on the web W follow sector, an infrared heater 62 can be fitted, which raises the temperatures of the web W and the roll 30 face 30' during the passage to the drying section and lowers the force of detaching of the web W from the roll 30.

In the following, a table will be given which indicates typical temperatures, $T_1$, $T_2$, $T_3$, $T_5$ and $T_4$ of a newsprint web W after nips $N_1$–$N_4$ provided with corresponding subscripts as well as typical dry solids contents $K_1$, $K_2$, $K_5$ and $K_4$ at the corresponding locations when the web heaters 17, 20, 40 are employed and when the temperature of the pulp in the headbox is about 55° C.

| Nip | Temperature after the nip (°C.) | Dry solids content after the nip (%) |
|---|---|---|
| $N_1$ | 45 | 30 |
| $N_2$ | 65 | 38 |
| $N_3$ | 80 | 45 |
| $N_4$ | 88 | 49 |

Many other variations of the present invention would be obvious to one skilled in the art, and are contemplated to be within the scope of the appended claims.

I claim:

1. A method for intensifying the dewatering of a web in a paper machine press section having a compact roll combination and a separate press, comprising pressing a web in a compact roll combination having three press nips, thereafter transferring the web from said compact roll combination on a paper guide roll and then onto an upper face of a press felt of a separate press comprising an upper smooth-faced roll, a lower hollow-faced roll, and a separate press nip defined between said upper smooth-faced roll and said lower hollow-faced roll, heating a lower face of the web and the web runs over a lower sector of said paper guide roll by means of a web heating device, heating the upper face of the press felt by means of a felt heating device before it contacts the lower face of the web, and removing water substantially from the lower face of the web into the upper face of the felt in said separate press nip, whereby the dewatering in said separate press nip is substantially intensified.

2. The method of claim 1, further comprising employing a steam box having curved walls as the web and felt heating devices, and arranging said steam box in said press section such that steaming gaps are formed both with said paper guide roll and with an area of a transfer-suction roll for said press felt arranged in proximity to said paper guide roll.

3. The method of claim 1, further comprising subjecting the web to said heating effect via the web heating device by providing steam treatment or infrared radiation on said lower sector of said paper guide roll, said lower sector having a magnitude in the range from about 40° to about 90°, transferring the web as a short free draw from said paper guide roll onto the outer face of the press felt of said separate press and onto a suction zone of a transfer-suction roll, the magnitude of said suction zone being from about 40° to about 90°, and heating the web and/or the felt at said suction zone by means of a second heating device.

4. The method of claim 3, further comprising providing as said second heating device two separate heating means employed for the heating of an upper face of the web and the upper face of the press felt of the separate press, respectively.

5. The method of claim 1, further comprising heating the web on a suction sector of a press-suction roll placed between a first and second nip of said compact press roll combination.

6. The method of claim 1, further comprising heating an upper face of the web on an outer sector of a smooth faced center roll of said compact press roll combination between a second and a third nip.

7. The method of claim 3, further comprising heating the web by means of said second heating device placed above said suction zone of said transfer-suction roll of the separate press.

8. The method of claim 3, further comprising heating the web on a covering sector of an upper press roll of said separate press nip, said covering sector being located in the running direction of the web after said separate press nip.

9. The method of claim 8, further comprising heating said web on said covering sector by means of infrared radiator devices and/or steam jets applied to a face of said upper press roll, whereby the temperature of said face of said upper press roll is heated and the cleaning of said face is promoted.

10. The method of claim 9, further comprising employing regulation in blocks for said second heating device by means of which the transverse temperature of the web and, thereby, the transverse profile of the dry solids content of the web, are controlled.

11. A press section of a paper machine, comprising a compact press roll arrangement comprising a smooth faced center roll forming at least first and second press nips with additional rolls of said compact press roll arrangement for a web, a paper guide roll arranged after said compact press roll arrangement in a direction of the running of the web, a transfer-suction roll located in proximity to said paper guide roll and after said paper guide roll in the direction of the running of the web, such that a gap is present between said paper guide roll and said transfer-suction roll, the web being detached from said smooth faced center roll of said compact press roll arrangement and arriving onto said paper guide roll as a short free draw, a lower face of the web thereafter being transferred onto an upper face of a first press felt on said transfer-suction roll, a separate press comprising an upper roll provided with a smooth face and a lower roll provided with a hollow face, said upper roll and said lower roll defining a separate press nip therebetween, the first press felt leading to said separate nip, such that water is substantially removed from the lower face of the paper web and into the upper face of the press felt in said separate nip, and a heating means located in connection with said gap between said paper guide roll and said transfer-suction roll and underneath said paper guide roll, said heating means extending across an entire transverse width of the web, said heating means structured and arranged for raising the temperature of both said lower face of the web and of said upper face of the first press felt, said arrangement thereby intensifying the dewatering of the web.

12. The press section of claim 11, said heating means comprising a steam supply box heating the web running on a lower sector of said paper guide roll and the run of said first press felt placed on a suction zone of said transfer-suction roll before the point of arrival of the web, said steam box comprising curved walls defining treatment gaps with the web and said first press felt, said curved walls including nozzle holes through which a plurality of steam jets are applied to the web and to said first press felt before the web and said first press felt contact each other.

13. The press section of claim 12, wherein said steam supply box is provided with regulation in blocks so that at least the output of the steam treatment applied to the web can be controlled in the transverse direction of the web by means of regulation valves or by a series of corresponding regulation means.

14. The press section of claim 11, wherein said smooth faced upper roll has a covering sector located in the running direction of the web after said separate press nip, said separate press section further comprising a cleaning doctor located at an upper sector of said smooth faced upper roll, and a second heating means heating the web on said covering sector of said upper press roll of said separate press nip, said second heating means being structural and arranged such that the temperature of the face of said upper roll is raised to promote the cleaning of said face.

15. The press section of claim 14, wherein said second heating means comprises a steam supply device placed before said cleaning doctor and by means of which steam jets can be applied to said roll face.

16. The press section of claim 14, wherein said separate press further comprises a third heating means located after said separate press nip, said third heating device raising the temperature of the web and promoting the detachment of the web from said roll face.

17. The press section of claim 16, wherein said third heating means comprises an infrared heater.

18. The press section of claim 16, further comprising a second press felt upon which the web is transferred after the web leaves said separate nip and located after said third heating means, said second press felt transferring said web into a drying section.

19. The method of claim 11, wherein said heating means comprises two separate heating devices employed for the heating of the lower face of the web and the upper face of said first press felt of the separate press, respectively.

* * * * *